US011761299B2

(12) United States Patent
Anderson

(10) Patent No.: US 11,761,299 B2
(45) Date of Patent: Sep. 19, 2023

(54) CEMENT PLUG AND BRIDGE PLUG ASSEMBLY AND METHOD

(71) Applicant: INNOVEX DOWNHOLE SOLUTIONS, INC., Houston, TX (US)

(72) Inventor: Adam Anderson, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/747,367

(22) Filed: May 18, 2022

(65) Prior Publication Data

US 2022/0372843 A1 Nov. 24, 2022

Related U.S. Application Data

(60) Provisional application No. 63/196,836, filed on Jun. 4, 2021, provisional application No. 63/190,280, filed on May 19, 2021.

(51) Int. Cl.

| | |
|---|---|
| ***E21B 33/16*** | (2006.01) |
| ***E21B 33/134*** | (2006.01) |
| ***E21B 23/04*** | (2006.01) |
| ***E21B 47/092*** | (2012.01) |

(52) U.S. Cl.

CPC ..... *E21B 33/165* (2020.05); *E21B 23/0414* (2020.05); *E21B 23/0417* (2020.05); *E21B 33/134* (2013.01); *E21B 47/092* (2020.05)

(58) Field of Classification Search

CPC ..... E21B 33/16; E21B 33/165; E21B 33/134; E21B 23/0417; E21B 47/092

See application file for complete search history.

(56) References Cited

U.S. PATENT DOCUMENTS

| | | | | |
|---|---|---|---|---|
| 5,323,856 | A * | 6/1994 | Davis | E21B 47/092 175/45 |
| 2015/0083410 | A1* | 3/2015 | Steele | E21B 47/024 166/255.3 |
| 2015/0136395 | A1* | 5/2015 | Turley | E21B 33/134 166/65.1 |
| 2016/0230533 | A1* | 8/2016 | Steele | E21B 47/18 |
| 2017/0122096 | A1* | 5/2017 | Durtler | G01V 3/26 |
| 2018/0016891 | A1* | 1/2018 | Rogozinski | E21B 47/09 |
| 2018/0245424 | A1* | 8/2018 | Stokley | E21B 47/092 |
| 2018/0313206 | A1* | 11/2018 | Dirksen | E21B 47/13 |
| 2021/0317721 | A1* | 10/2021 | Santoso | E21B 33/124 |
| 2022/0178220 | A1* | 6/2022 | Carroll | E21B 33/1208 |

* cited by examiner

*Primary Examiner* — Shane Bomar

(74) *Attorney, Agent, or Firm* — MH2 TECHNOLOGY LAW GROUP LLP

(57) ABSTRACT

A plug assembly for a cementing operation in a well includes a bottom wiper plug configured to land in or near the toe of a well and receive a cement slurry therethrough, a top wiper plug releasably coupled to the bottom wiper plug and configured to land on the bottom wiper plug after the cement slurry is received through the bottom wiper plug, a bridge plug coupled to the top wiper plug and configured to move toward the bottom wiper plug with the top wiper plug after the bottom wiper plug is landed in or near the toe of the well, and a sensor sub coupled to the bridge plug and configured to detect a gate in the well.

17 Claims, 4 Drawing Sheets

CEMENT PLUG AND BRIDGE PLUG ASSEMBLY AND METHOD

CROSS-REFERENCE TO RELATED APPLICATIONS

This application claims priority to U.S. Provisional Patent application having Ser. No. 60/190,280, which was filed on May 19, 2021. This application also claims priority to U.S. Provisional Patent Application having Ser. No. 63/196,836, which was filed on Jun. 4, 2021. Each of these priority patent applications is incorporated by reference herein in its entirety.

BACKGROUND

The construction of wells, e.g., oil and gas wells, often includes running tubular casing into the wells. The casing is secured in place in the well using cement. In particular, once the casing is run to a desired location, cement slurry is pumped down through the interior of the casing, out through its lower end, and back up into the annulus between the wellbore wall and the casing.

Various different pieces of equipment and tools are employed in the cementing process. For example, a float collar may be positioned at the bottom of the casing that is to be cemented in the well. The float collar permits cement to exit the bottom of the casing and may prevent reverse flow of cement back into the casing. A top wiper plug and a bottom wiper plug may also be provided. These plugs may be configured to permit flow of cement therethrough and into the casing, and may also be configured to catch a dart or plug. For example, the bottom wiper plug may catch a smaller dart than the top wiper plug, and thus the smaller dart may pass through the top wiper plug on its way to the bottom wiper plug. Having caught the dart, the pressure above the bottom wiper plug may increase until it is released from the top of the casing, and deployed into the casing, towards the float collar (and/or other float equipment). The cement slurry may follow the bottom wiper plug, and then may fracture or otherwise pass through the bottom wiper plug once the bottom wiper plug lands on the float collar. The top wiper plug may catch a dart or otherwise be released to follow the cement slurry through the casing, and may land on the bottom wiper plug when the cement has been forced out of the casing via the float collar.

A bridge plug may then be run into the well and set above the float equipment, e.g., to isolate the interior of the casing above the float equipment and permit operations, such as fracturing, to be accomplished above the float equipment. Accordingly, there may be two tool running processes that occur in sequence, e.g., running the cement plug and pumping the cement, and then running and setting the bridge plug. In subsea applications, and other deep well applications, running tools into the well can take a significant amount of time and, since rigs are frequently rented by the day, such time directly correlates to expense.

SUMMARY

A plug assembly for a cementing operation in a well is disclosed. The assembly includes a bottom wiper plug configured to land in or near the toe of a well and receive a cement slurry therethrough, a top wiper plug releasably coupled to the bottom wiper plug and configured to land on the bottom wiper plug after the cement slurry is received through the bottom wiper plug, a bridge plug coupled to the top wiper plug and configured to move toward the bottom wiper plug with the top wiper plug after the bottom wiper plug is landed in or near the toe of the well, and a sensor sub coupled to the bridge plug and configured to detect a gate in the well.

A method is disclosed. The method includes cementing a tubular in a well using a bottom wiper plug and a top wiper plug, detecting that a bridge plug connected to the top wiper plug has reached or passed a gate in the tubular, while the bridge plug and the top wiper plug descend in the tubular as part of the cementing, and setting the bridge plug at least partially in response to detecting that the bridge plug has reached or passed the gate.

A plug assembly for a cementing operation in a well is disclosed. The assembly includes a bottom wiper plug configured to land in or near the toe of a well and receive a cement slurry therethrough, a top wiper plug releasably coupled to the bottom wiper plug and configured to land on the bottom wiper plug after the cement slurry is received through the bottom wiper plug, a bridge plug coupled to the top wiper plug and configured to move toward the bottom wiper plug with the top wiper plug after the bottom wiper plug is landed in or near the toe of the well, a sensor sub coupled to the bridge plug and comprising a magnetic sensor configured to detect a gate in the well, and a setting tool coupled to the bridge plug and configured to connect to a tool string to run the plug assembly into a well. The setting tool releases from the tool string prior to setting the bridge plug, the setting tool being configured to set the bridge plug.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
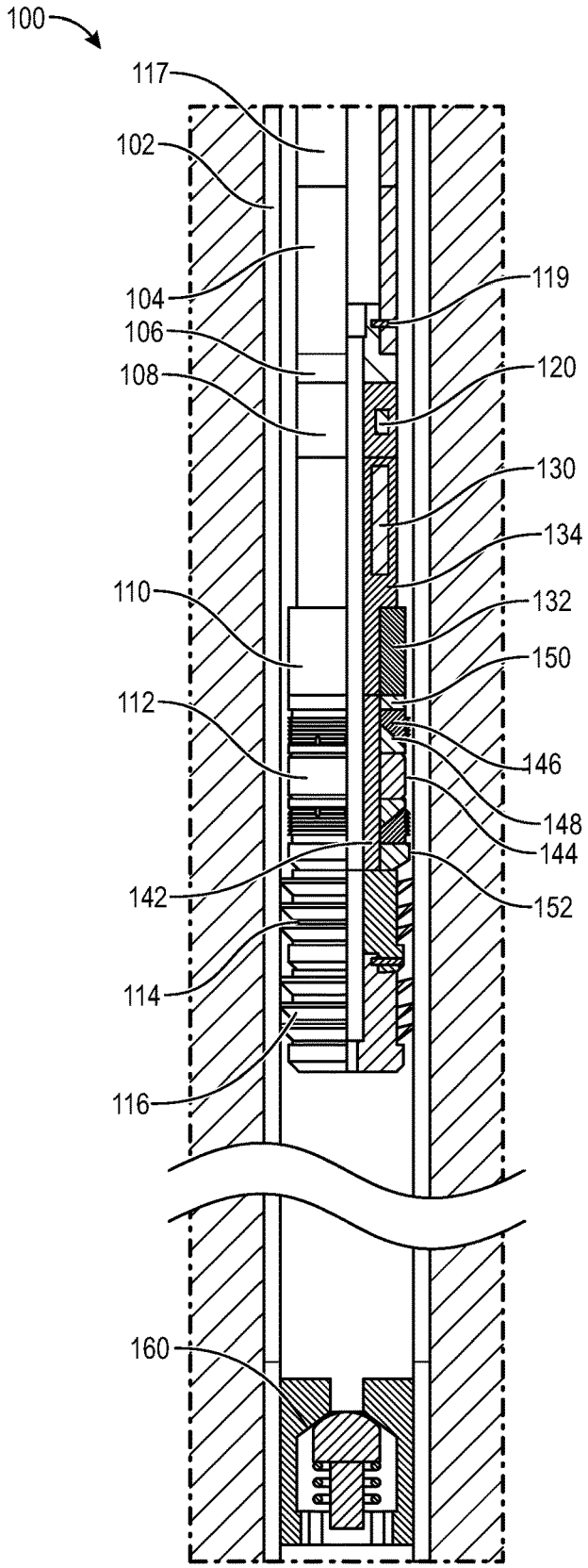
FIG. 1 illustrates a side view of a plug assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side view of a plug assembly 100 positioned in a casing (or any other oilfield tubular) 102, according to an embodiment. The plug assembly 100 may be configured for use in a cementing operation in a well. The plug assembly 100 may generally include a running tool 104, a coupling 106, a sensor sub 108, a setting tool 110, a bridge plug 112, a top wiper plug 114, and a bottom wiper plug 116. These components 104-116 (potentially with other components therebetween or connected thereto) may be connected together, end-to-end as shown, prior to deployment and deployed into the casing 102 in the well as a single unit, e.g., attached to a single work or "tool" string (e.g., any string of tubulars or tubing used to deploy tools into a well). The ordering of the components 104-116 is merely an example, however. In other examples, the sensor sub 108 could be positioned between the bridge plug 112 and the top wiper plug 114, or in another location relative to the other components 104, 106, 110, 112, 114, 116.

In an embodiment, the running tool 104 may be connected to the tool string 117 and may provide a top end of the plug assembly 100. The coupling 106 may be a shear coupling that is configured to yield or otherwise be actuated so as to release at least some of the components of the plug assembly 100 from the tool string 117. For example, as shown, the coupling 106 may be connected to the running tool 104 via a shear member 119 (e.g., a shear pin). In some embodiments, the coupling 106 may be integrated into the running tool 104, the sensor sub 108, or another member, and may thus not form a separate piece in the assembly 100.

The sensor sub 108 may be coupled to the coupling 106 and may include a sensor 120. The sensor 120 may be a magnetic sensor (e.g., a Hall effect sensor), an RFID reader, drill collar counting device, mechanical restriction counting device, or any other type of sensor that may be configured to detect proximity to a "gate" (e.g., a magnetic field or other signal generated at, or structure located at, a particular location). The sensor 120 may be configured to detect that the sensor sub 108 (and thus the bridge plug 112) has reached or passed (as the bridge plug 112 continues to descend) the gate. For example, the casing 102 may be provided with such a device 122 (shown in FIGS. 3-5, as will be described below) that generates or otherwise provides such a gate. In a specific embodiment, the device 122 may be a permanent magnet embedded in a sub connected to the casing 102 or otherwise connected to the casing 102. In some embodiments, the device 122 may include two or more magnets, e.g., circumferentially offset from one another and/or disposed at two or more axial locations (depths) to ensure that the sensor 120 passes in sufficiently close proximity to the device 122 to recognize the gate. Likewise, the sensor sub 108 may include two or more sensors, e.g., circumferentially and/or axially offset, so as to ensure that the device 122 is detected and thus the gate is recognized.

The device 122 may be positioned at a location proximal to where (e.g., below which) the bridge plug 112 may be desired to be set. Thus, the sensor 120 sensing the device 122 (e.g., passing by the gate) may present a trigger for setting to occur, e.g., automatically or by notification to and intervention from a user or an external (e.g., surface) system.

The setting tool 110 may be connected to or integrated with the sensor sub 108, and connected to the bridge plug 112. The setting tool 110 may include, for example, a gas charge 130, a setting sleeve 132 that is connected to the bridge plug 112, and an internal, movable piston 134. At a desired time, as will be described below, the setting tool 110 may be actuated so as to set the bridge plug 112. At this time, the charge 130 may be ignited, which may drive the piston 134 relative to the sleeve 132, producing a push-pull force coupling that is applied to the bridge plug 112, thereby causing the bridge plug 112 to be axially compressed and radially expanded. In another embodiment, the setting tool 110 may be hydrostatic, and may include a port and piston. Upon reaching the setting location, the port may be opened and the downhole pressure communicated to the piston. Such hydrostatic pressure may cause the piston to stroke, as the opposing piston chamber may be filled with, for example, air at surface pressure. Stroking the piston may set the bridge plug 112.

The bridge plug 112 may include a setting assembly 140 that reacts to the push-pull force coupling discussed above. For example, the bridge plug 112 may include a mandrel 142, around which the setting assembly 140 is positioned. The setting assembly 140 may include one or more expandable (e.g., elastomeric) sealing elements 144, cones 146, slips 148, an upper collar 150, and a lower collar 152. The upper collar 150 may engage the sleeve 132 of the setting tool 110. The lower collar 152 may be secured to the mandrel 142, such that axial movement of the mandrel 142 causes the lower collar 152 to move as well. Accordingly, the mandrel 142 may be pulled upwards by the setting tool 110 while the upper collar 150 is pushed downwards by the setting tool 110, thereby causing the upper collar 150 and the lower collar 152 to be forced toward one another. When this occurs, the slips 148 are wedged outwards by the cones 146, and the sealing elements 144 are deformed radially outwards. The slips 148 and the sealing elements 144 may engage the casing 102, thereby forming an anchored, sealed engagement therewith. The bridge plug 112 may include a valve that is then deployed to isolate the top and bottom of the bridge plug 112 from one another, or may include a valve seat to catch an obstructing member so as to provide such isolation. Various back-out prevention assemblies may also be provided (e.g., lock rings, ratchets, etc.) to prevent the bridge plug 112 from unsetting.

The top and bottom wiper plugs 114, 116 are located below and connected to the bottom of the bridge plug 112. The bottom wiper plug 116 may be releasable from the top wiper plug 114, e.g., in response to a pressure exceeding a certain threshold. Once released, the bottom wiper plug 116 may lead a cement slurry down through the casing 102, until the bottom wiper plug 116 lands at a device located in or near a toe of the well, e.g., on a float tool 160 (e.g., float collar, float valve, etc.) located at the bottom of the casing 102. The float tool 160 may provide a one-way valve to prevent reverse flow of the cement slurry (and/or other well fluids) into the casing 102. The top wiper plug 114 may, in at least some embodiments, be secured to the bridge plug 112 such that it is not releasable therefrom in normal operation.

In at least some embodiments, the plug assembly 100 may also include one or more contingency features. Such contingency features may be provided to address situations in which the bridge plug 112 does not properly set in the well, e.g., the bridge plug 112 may be partially set and thus not adequately seal, or may fail to set altogether. For example, the bridge plug 112 may include a fishing neck, which may permit the bridge plug 112 to be retrieved, if unset. Further, the bridge plug 112 may include a latch, which a superposed bridge plug may be deployed onto and subsequently set. A variety of such contingency features may be used.

Figure 2:
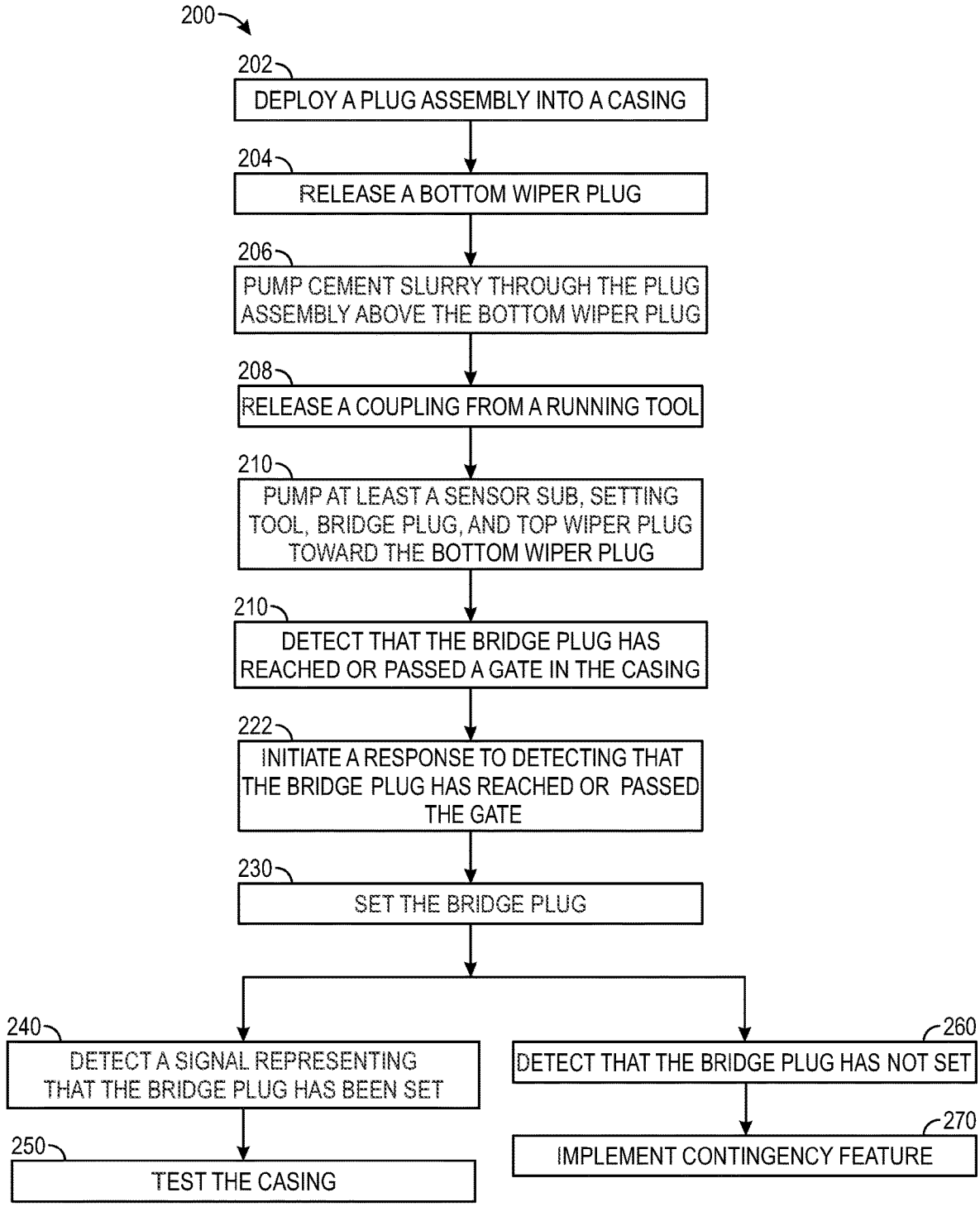
FIG. 2 illustrates a flowchart of a method for operating the plug assembly, according to an embodiment.

FIG. 1 illustrates the plug assembly 100 in a run-in state, e.g., the configuration of the plug assembly 100 generally as it is constructed at the surface and run into a well, before a cement job has been conducted using the plug assembly 100. FIG. 2 illustrates a flowchart of a method 200 for using a cement plug assembly, such as the plug assembly 100 for a cement job, according to an embodiment. Execution of the method 200 may move the plug assembly 100 through several states, which are shown in and described below with reference to FIGS. 3-5. It will be appreciated, however, that other plug assemblies may be implemented consistent with the method 200; further, the steps of the method 200 may be executed in the order described, or in any other order. Additionally, certain steps may be combined or performed in parallel. Any of the individual steps may also be broken into two or more steps, performed in sequence or parallel.

The method 200 may begin by deploying the plug assembly 100 into the casing (or another tubular) 102, as at 202, with the plug assembly 100 including, for example, the components discussed above. The plug assembly 100 may be connected to a tool string 117 via the running tool 104. The plug assembly 100 may be configured to be used to cement the casing 102 in a well, as will be described in greater detail, according to an example, below.

Figure 3:
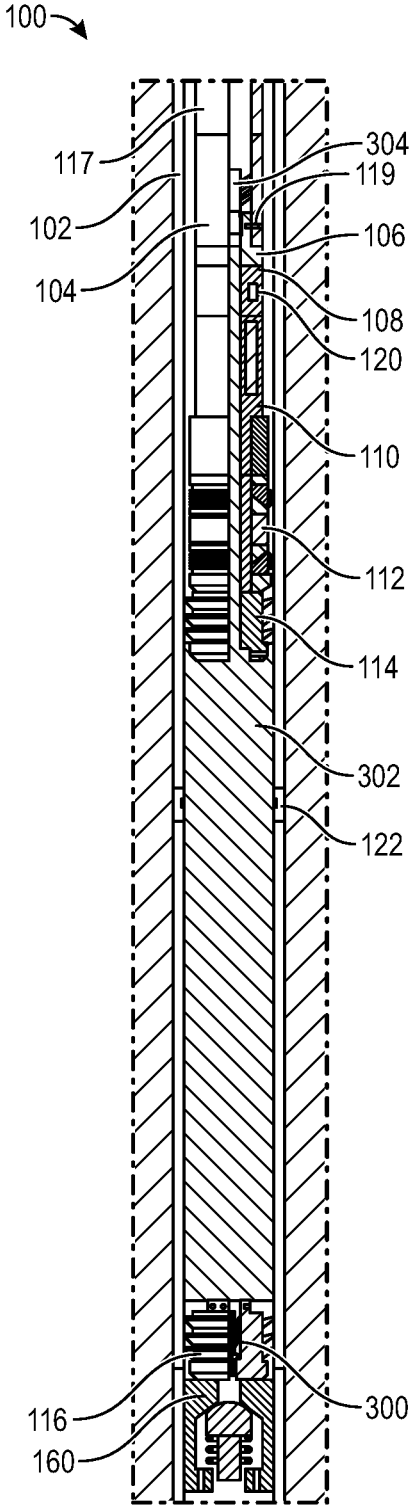
FIG. 3 illustrates a side view of the plug assembly after a bottom wiper plug thereof has been released and descended to a float tool therebelow, according to an embodiment.

In an embodiment, as part of cementing operation, the method 200 may include releasing the bottom wiper plug 116, as at 204, and pumping a cement slurry through the remaining components of the plug assembly 100 above the bottom wiper plug 116, as at 206. As shown in FIG. 3, a dart (or other obstructing member) 300 may be deployed and caught in an inner profile (seat) of the bottom wiper plug 116. A cement slurry 302 may then be delivered and pressured up to force the bottom wiper plug 116 to release from connection with the top wiper plug 114.

Figure 4:
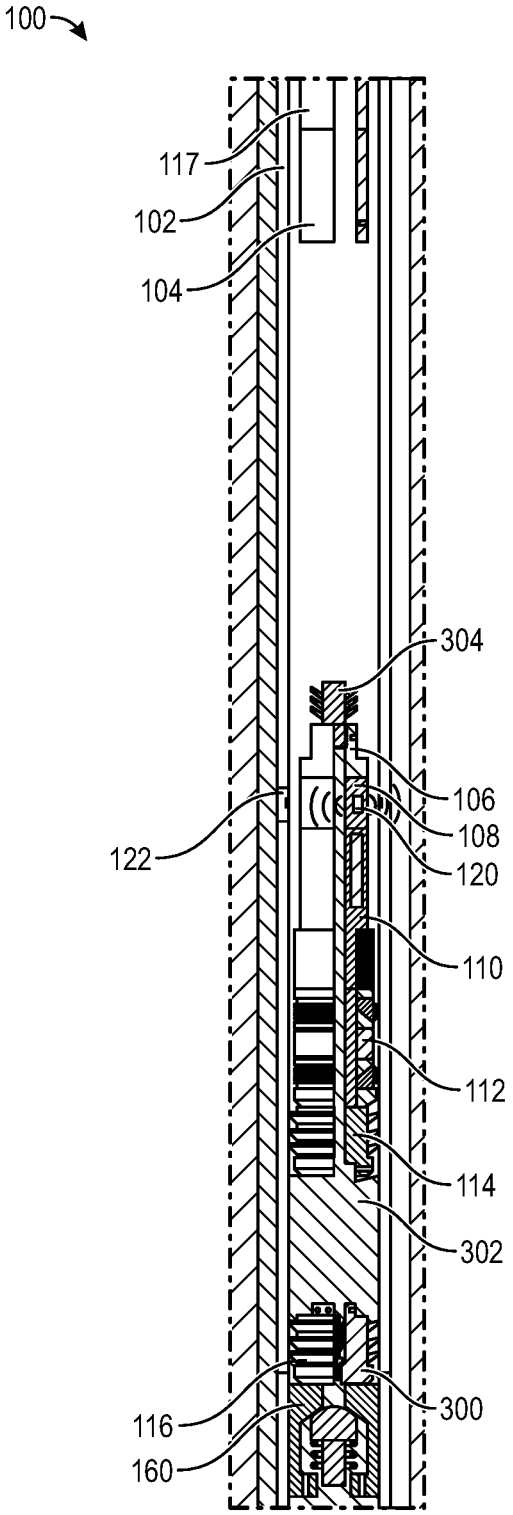
FIG. 4 illustrates a side view of the plug assembly after a top wiper plug, bridge plug, and sensor sub (among potentially other components) of the plug assembly have been released and descended into proximity of a gate in the casing, according to an embodiment.

The method 200 may include releasing the coupling 106 from the running tool 104, as at 208, and pumping at least the sensor sub 108, setting tool 110, bridge plug 112 and the top wiper plug 114 may downwards from the running tool 104 toward the bottom wiper plug 116, as at 210. As a result of pumping down the components 108-114, the cement slurry 302 may be displaced from the casing 102 through the float tool 160 via the bottom wiper plug 116. In a specific embodiment, releasing the coupling 106 may be accomplished by deploying a second dart 304, as shown in FIGS. 3 and 4, which may be caught by an internal profile in the coupling 106 (or in the top wiper plug 114 or another component). As shown in FIG. 4 specifically, pressure above the dart 304 may then be increased, such that the shear member 119 (FIG. 3) yields and releases the coupling 106, and the sensor sub 108, setting tool 110, bridge plug 112, and top wiper plug 114 attached thereto, from the running tool 104. Thus, the coupling 106, the sensor sub 108, the setting tool 110, the bridge plug 112, and the top wiper plug 114 may be pumped downward in the casing 102, toward the bottom wiper plug 116. As this occurs, the bottom wiper plug 116 (or the dart 300) is fractured and permits the cement slurry 302 to be pressed therethrough, through the float tool 160, and into an annulus 304 formed between the casing 102 and the wellbore wall.

The slurry 302 may fill the casing 102 between the bottom wiper plug 114 and the coupling 106 as the coupling 106 moves downward. In some embodiments, the cement slurry 302 may only fill between the top and bottom wiper plugs 114, 116. The top wiper plug 114 remains connected to the bridge plug 112 and thus the remainder of the plug assembly 100.

The method 200 may include detecting that the bridge plug 112 has reached a gate in the casing 102, e.g., using the sensor sub 108, as at 220. This is also shown in FIG. 4. The gate may be provided by the device 122, e.g., a magnet embedded in the casing 102, as discussed above. The sensor sub 108 may include the sensor 120 configured to detect proximity to the device 122 (e.g., detecting the gate).

The sensor sub 108 detecting the gate may provoke a response at least partially in the plug assembly 100, as at 222. The response may include, for example, initiating a timer in a processor of the sensor sub 108 or setting tool 110 (or any other component of the plug assembly 100). The response may also be or include sending a signal to an external (e.g., surface) system. The response may be sending a signal to the setting tool 110 to initiate a setting sequence.

In some embodiments, the sensor sub 108 may reach the gate prior to reaching a location where the bridge plug 112 is to be set; that is, the location is proximal to the setting location, but at a shallower depth. Accordingly, in response to the sensor sub 108 reaching the gate, a delayed response may be initiated. The delay may be controlled, for example, via a microprocessor positioned in the sensor sub 108 and configured to initiate a timer set to a duration calculated to permit the bridge plug 112 to reach a desired location in the casing 102 (e.g., associated with the top wiper plug 114 landing on the bottom wiper plug 116). The duration of the timer may be static and predetermined or calculated dynamically based on a descent rate of the bridge plug 112 through the casing 102.

Figure 5:
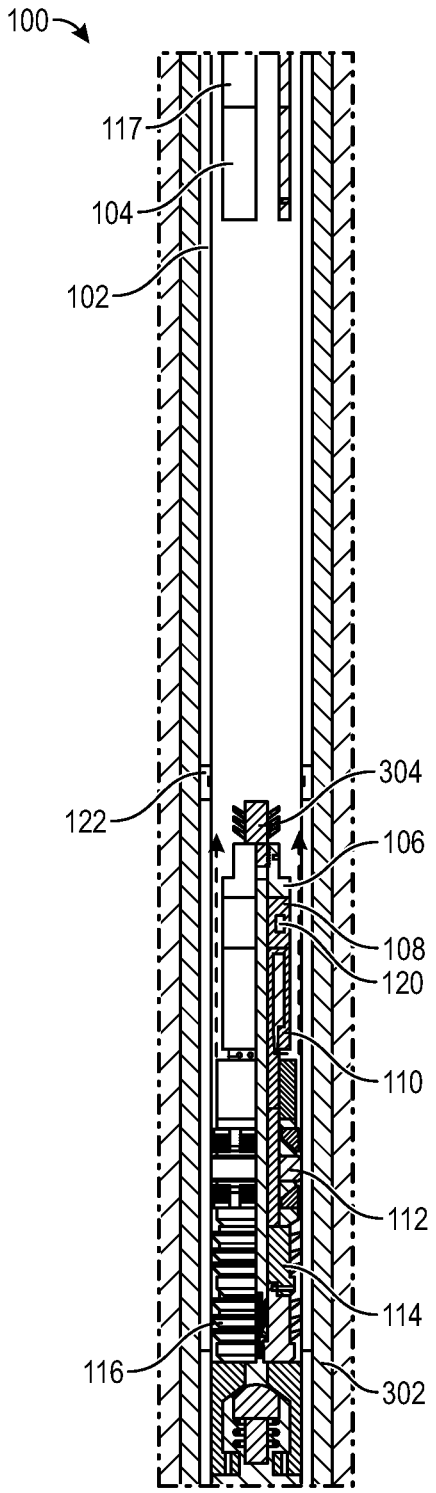
FIG. 5 illustrates a side view of the plug assembly after the bridge plug thereof has been set in the casing, according to an embodiment.

The method 200 may then include setting the bridge plug 112 using the setting tool 110, as at 230. As shown at FIG. 5, the bridge plug 112 may reach its setting location, e.g., after less than the predetermined duration of the timer initiated by the sensor sub 108 detecting the gate. Once the predetermined duration has elapsed (or another trigger response has occurred), the bridge plug 112 may be set. For example, the sensor sub 108 may send a signal to the setting tool 110 to ignite the charge 130. The setting tool 110 igniting the charge 130 may set the bridge plug 112 as discussed above. As shown, the setting tool 110 may not be connected to the tool string 117 when it is used to set the bridge plug 112. Thus, in at least some embodiments, the setting process may be autonomous.

The method 200 may also include detecting a signal representing that the bridge plug 112 has been set, as at 240. For example, during the setting, the charge 130 may release compressed gas as the piston 134 is stroked upwards, e.g., pass a gas release port. This may produce a pressure pulse in the fluid environment in the casing 102, which may propagate to a pressure sensor located at the surface (or wellhead, or any other convenient location). This pressure pulse may represent an indication that the bridge plug 112 has been set. Further, positive/negative pressure testing of the casing 102 can be implemented to detect if the bridge plug 112 was successfully set, as at 250. If no pressure pulse is detected, or testing reveals that the bridge plug 112 is not adequately sealing or holding, as at 260, a contingency feature may be implemented, as at 270. Implementing a contingency feature may refer to taking one or more actions/processes that make use of a feature designed for such partial or un-set situations. For example, the bridge plug 112 may be retrieved and a new bridge plug run, or a bridge plug may run down on top of the bridge plug 112, to name just two examples.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A plug assembly for a cementing operation in a well, comprising:

a bottom wiper plug configured to land in or near a toe of a well and receive a cement slurry therethrough;

a top wiper plug releasably coupled to the bottom wiper plug and configured to land on the bottom wiper plug after the cement slurry is received through the bottom wiper plug;

a bridge plug coupled to the top wiper plug and configured to move toward the bottom wiper plug with the top wiper plug after the bottom wiper plug is landed in or near the toe of the well;

a sensor sub coupled to the bridge plug and configured to detect a gate in the well; and a setting tool coupled to the bridge plug, wherein the setting tool is configured to set the bridge plug via hydrostatic force or detonation.

2. The plug assembly of claim 1, wherein the sensor sub comprises a magnetic sensor configured to detect a magnet embedded in a surrounding tubular at a position proximal to a location where the bridge plug is to be set.

3. The plug assembly of claim 1, further comprising a coupling that connects the bridge plug, the sensor sub, the bottom wiper plug, and the top wiper plug to a tool string, wherein the coupling is releasable from the tool string to permit the top wiper plug, the bridge plug, and the sensor sub to descend toward the bottom wiper plug.

4. The plug assembly of claim 3, wherein the coupling is configured to catch a dart such that a pressure above the coupling causes the coupling to release from the tool string.

5. The plug assembly of claim 1, wherein the setting tool is configured to set the bridge plug without being connected to a tool string, wherein the setting tool communicates with the sensor sub so as to initiate a setting process at least partially in response to the sensor sub detecting the gate.

6. A plug assembly for a cementing operation in a well, comprising:

a bottom wiper plug configured to land in or near a toe of a well and receive a cement slurry therethrough;

a top wiper plug releasably coupled to the bottom wiper plug and configured to land on the bottom wiper plug after the cement slurry is received through the bottom wiper plug;

a bridge plug coupled to the top wiper plug and configured to move toward the bottom wiper plug with the top wiper plug after the bottom wiper plug is landed in or near the toe of the well;

a sensor sub coupled to the bridge plug and configured to detect a gate in the well; and a setting tool coupled to the bridge plug, wherein the setting tool includes a gas release port, the setting tool configured to release compressed gas via the gas release port while setting the bridge plug.

7. The plug assembly of claim 1, further comprising a device embedded at least partially in a surrounding tubular, wherein the sensor sub comprises a sensor configured to detect when the sensor is within a predetermined range of the device, and wherein the device provides the gate.

8. A method, comprising:

cementing a tubular in a well using a bottom wiper plug and a top wiper plug;

detecting that a bridge plug connected to the top wiper plug has reached or passed a gate in the tubular, while the bridge plug and the top wiper plug descend in the tubular as part of the cementing;

actuating a setting tool to set the bridge plug at least partially in response to detecting that the bridge plug has reached or passed the gate, wherein the setting tool exhausts a pressure pulse of a compressed gas when the bridge plug is set; and determining that the bridge plug has been set by detecting the pressure pulse.

9. The method of claim 8, further comprising initiating a timer in response to detecting that the bridge plug has reached the gate, wherein setting the bridge plug occurs in response to expiration of the timer.

10. The method of claim 9, wherein the bridge plug descends in the tubular along with the top wiper plug, and wherein the top wiper plug descending forces cement through the bottom wiper plug and into an annulus between the tubular and the well.

11. The method of claim 8, further comprising detecting that the bridge plug has not been set and, in response to detecting that the bridge plug has not been set, implementing a contingency process.

12. The method of claim 8, wherein actuating the setting tool comprises permitting hydrostatic force to act on a movable piston of the setting tool or detonating a charge in the setting tool.

13. A method, comprising:

cementing a tubular in a well using a bottom wiper plug and a top wiper plug, wherein cementing comprises:

releasing the bottom wiper plug from the top wiper plug;

pumping cement through a bridge plug and the top wiper plug;

landing the bottom wiper plug on a float tool;

pumping cement through the bottom wiper plug and the float tool;

releasing the bridge plug and the top wiper plug from a tool string; and pumping the bridge plug and the top wiper plug toward the bottom wiper plug;

detecting that the bridge plug connected to the top wiper plug has reached or passed a gate in the tubular, while the bridge plug and the top wiper plug descend in the tubular as part of the cementing; and setting the bridge plug at least partially in response to detecting that the bridge plug has reached or passed the gate.

14. The method of claim 8, wherein setting the bridge plug comprises actuating a setting tool coupled to the bridge plug, wherein the setting tool is released from the tool string and pumped along with the bridge plug and the top wiper plug toward the bottom wiper plug prior to setting the bridge plug.

15. The method of claim 8, wherein detecting that the bridge plug has reached the gate comprises using a sensor in a sensor sub connected to the bridge plug to detect the gate.

16. The method of claim 15, wherein the sensor comprises a magnetic sensor, wherein the gate comprises a magnet embedded at least partially in the tubular, and wherein detecting that the bridge plug has reached or passed the gate comprises the sensor detecting a magnetic field generated by the magnet.

17. A plug assembly for a cementing operation in a well, comprising:

a bottom wiper plug configured to land in or near a toe of a well and receive a cement slurry therethrough;

a top wiper plug releasably coupled to the bottom wiper plug and configured to land on the bottom wiper plug after the cement slurry is received through the bottom wiper plug;

a bridge plug coupled to the top wiper plug and configured to move toward the bottom wiper plug with the top wiper plug after the bottom wiper plug is landed in or near the toe of the well;

a sensor sub coupled to the bridge plug and comprising a magnetic sensor configured to detect a gate in the well; and a setting tool coupled to the bridge plug and configured to connect to a tool string to run the plug assembly into the well, wherein the setting tool releases from the tool string prior to setting the bridge plug, the setting tool being configured to set the bridge plug.

* * * * *